United States Patent [19]

Gregory

[11] 4,432,337

[45] Feb. 21, 1984

[54] METHOD AND APPARATUS FOR EFFICIENTLY CAPTURING AND DISTRIBUTING HEAT PRODUCED BY GAS LOGS

[76] Inventor: Willis H. Gregory, Rte. 2, Angier, N.C. 27501

[21] Appl. No.: 261,880

[22] Filed: May 8, 1981

[51] Int. Cl.[3] ..... F24B 7/00

[52] U.S. Cl. ..... 126/121

[58] Field of Search ..... 126/121, 120, 131, 127, 126/128, 129; 237/51

[56] References Cited

U.S. PATENT DOCUMENTS

| | | | |
|---|---|---|---|
| 1,621,135 | 3/1927 | Sala | 126/121 |
| 1,703,459 | 2/1929 | Sala | 126/121 |
| 4,008,704 | 2/1977 | Petrie | 126/121 |
| 4,188,939 | 2/1980 | Gamso et al. | 126/121 |

FOREIGN PATENT DOCUMENTS

| | | | |
|---|---|---|---|
| 135380 | 11/1919 | United Kingdom | 126/121 |

*Primary Examiner*—Samuel Scott
*Assistant Examiner*—Randall L. Green
*Attorney, Agent, or Firm*—B. B. Olive

[57] ABSTRACT

The present invention relates to a method and apparatus for efficiently capturing heat generated by a fuel source such as gas or gas logs and distributing the heat produced thereby into selected areas of a structure. In a fireplace environment having gas logs therein, the present invention entails a duct structure extending generally over the gas logs. A fan is provided about an inlet end of the duct structure and produces a primary system of forced air that is introduced into the duct structure and moved therethrough, generally over the gas logs within the fireplace. In an area overlying the gas logs, the duct structure is provided with an opening and a transverse restrictor plate disposed within the duct adjacent the opening. As the system of forced air passes the restricted area, warm or hot air heated by the gas logs underlying the duct structure is induced into the duct structure where the same combines with the already produced system of air passing through the duct structure. Consequently the warm or heated air combines with the primary system of air to form a heated forced air system that is exhausted from the duct into an adjoining room or rooms for heating the structure.

2 Claims, 3 Drawing Figures

METHOD AND APPARATUS FOR EFFICIENTLY CAPTURING AND DISTRIBUTING HEAT PRODUCED BY GAS LOGS

FIELD OF INVENTION

The present invention relates to heat exchanger devices and devices used in fireplaces for efficiently capturing and distributing heat produced from a fuel source burned within said fireplace and more particularly to a method and apparatus of this character adapted to be used in conjunction with gas logs and the like for capturing heat produced thereby and effectively and efficiently distributing this heat within a structure to heat the same.

BACKGROUND OF INVENTION

In recent years, the popularity and commercial success of solid fuel burning stoves, fireplace inserts, furnaces and the like has been most surprising. Many factors have contributed to this commercial success and acceptance. Perhaps foremost has been the ever increasing cost of conventional forms of energy used in heating, that is petroleum fuels and electricity. Secondly, stoves and fireplace inserts have been greatly improved in design from an energy viewpoint compared to preexisting stoves and fireplace inserts. Stoves and fireplace inserts commerically available today are very efficient, and are in fact designed such that the heat output can be easily controlled. Thirdly, many people have ready access to wood, and even if they don't, wood can be purchased at a competitive price with respect to conventional forms of energy.

Aside from stoves and fireplace inserts, fireplaces continue to be very popular among people, especially because of the aesthetic value received therefrom. The use of heat exchangers within the fireplace has greatly increased the efficiency of what use to be a very poor and inefficient approach to heating.

To gain the aesthetic values of a fireplace, but yet not be bothered with the trouble and inconvenience of maintaining a wood fire, many people have opted to use gas logs within their fireplace. For the most part, this gives the desired aesthetic value. But as with conventional fireplaces, the heating is very inefficient. In the case of gas logs, the heat produced from the gas logs tends to remain static and stationary about the fireplace, and does not tend to move in such a way as to evenly distribute the heat within the structure.

Therefore, there is a need for a heat exchanger or apparatus that is designed and adapted to be used in connection with gas logs for efficiently capturing and distributing the heat produced thereby within an associated structure.

SUMMARY OF INVENTION

The present invention entails a method and apparatus for efficiently capturing heat produced by gas logs within a fireplace and distributing that heat, in a forced air manner, throughout an associated structure. To accomplish this, the present invention provides an apparatus that includes a duct structure that extends generally over a gas log set. Provided with the duct structure is a fan assembly for generating a system of primary air that is directed into and through the duct structure. The duct structure is designed to induce the relatively warm or hot air overlying and surrounding the gas logs into the duct structure where the same mixes and combines with the primary system of air being directed therethrough to form a system of heated air that is exhausted from the duct into an adjoining room or rooms or otherwise directed to an area of the structure for distribution.

It is, therefore, an object of the present invention to provide a method and apparatus for use in conjunction with gas logs or other fuel sources of the same character, for efficiently capturing heat produced thereby and distributing the same to heat a structure.

A further object of the present invention resides in the provision of an apparatus adapted and designed to be situated within a fireplace for effectively capturing heat produced by a gas log set or the like and efficiently distributing the heat into the structure housing the fireplace.

Still a further object of the present invention resides in the provision of a method and apparatus for capturing and distributing heat produced by a gas log set or the like wherein a system of primary carrying air is generated and directed through an exchanger assembly that is designed to induce relatively warm or hot air surrounding the gas log set thereinto where the relatively warm or heated air is combined with a primary carrying air which is then exhausted from the exchanger to provide heating for the structure.

It is also an object of the present invention to provide a method and apparatus of the character referred to herein that is automatically thermostatically controlled.

A further object of the present invention resides in the provision of an apparatus or heat exchanger device of the character referred to above that is relatively simple in design, easy to manufacture, reliable, and very efficient in capturing and distributing heat produced by the gas log set.

Other objects and advantages of the present invention will become apparent from a study of the following description and the accompanying drawings which are merely illustrative of the present invention

With further reference to the drawings, the apparatus of the present invention is shown therein and indicated generally by the numeral 10. Apparatus 10 is in the form of a heat exchanger device as the same is designed to be utilized in conjunction with a gas log set or other similar type heating device where the heat exchanger device acts to efficiently capture heat produced and to distribute the same within a structure for heating the same.

Figure 3:
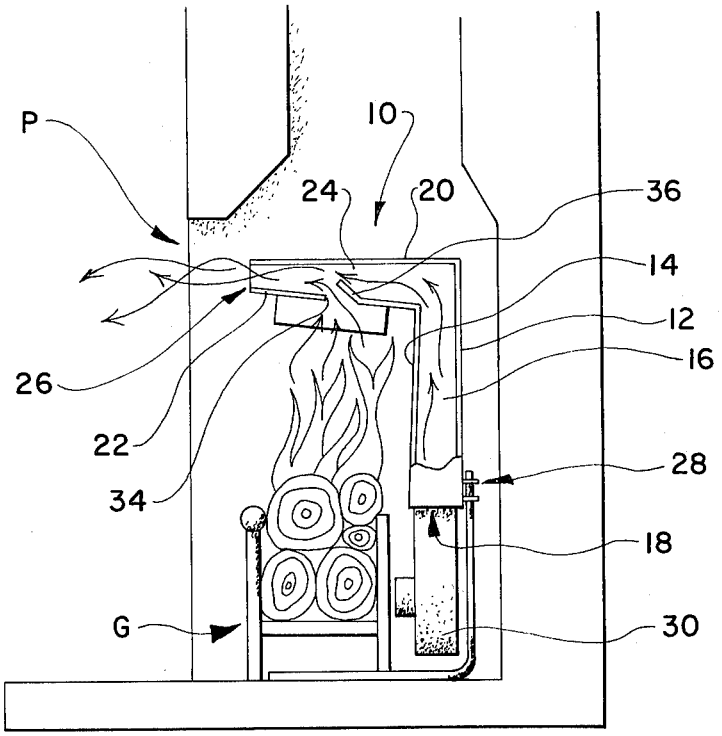
FIG. 3 is a side sectional view of a fireplace having a gas log set disposed therein with the apparatus or heat exchanger device of the present invention disposed within said fireplace adjacent said gas log set for capturing and distributing the heat thereof.

Viewing the apparatus 10 in more detail, it is seen that the same is adapted to set within a fireplace P and to extend and generally overlie the source of heat within the fireplace which in the present disclosure entails a gas log set G (FIG. 3).

Apparatus or heat exchanger device 10 comprises a basic L-shape duct structure. Forming a part of the L-shaped duct structure is a vertical leg section that includes a back 12, front 14, and a pair of sides 16 which are fabricated together to form a generally enclosed duct section.

As oriented in the embodiment illustrated herein, formed about the lower portion of the vertical leg is an inlet end 18.

Continuing to refer to L-shaped duct structure forming a part of the apparatus or heat exchanger 10 of the present invention, it is seen that the same includes a horizontal duct section extending from the vertical leg section, with the horizontal section extending generally over and above the gas log set G. Viewing the horizontal section, it is seen that the same includes a generally rectangular cross sectional assembly comprising a top wall 20, a bottom wall 22, and a pair of joining sides 24. It is noted that the horizontal section just referred to is communicatively connected to the vertical leg section such that air entering inlet end 18 may be forced through the vertical leg and horizontal duct sections where the same air may exit out an exhaust end 26 defined about the horizontal duct section just described.

Operatively connected adjacent inlet end 18 is a fan assembly 30. Fan assembly 30 in the case of the embodiment illustrated herein is of the squirrel cage type, but it is to be understood that other fan designs could be utilized. Fan 30, as will be subsequently appreciated is designed to generate a primary system of forced air that moves from inlet end 18 through the vertical leg and then dog legs into the above described horizontal section, where the air is exhausted from exhaust end 26 thereof. To automatically control fan 30 a thermostat 32 can be disposed within the duct structure, as indicated in drawings, and is operative to automatically actuate fan 30 once the surrounding temperature sensed by the thermostat 32 reaches a predetermined level.

Apparatus or heat exchanger device 10 is designed to effectively capture heated air disposed about the gas log set G and to efficiently distribute the heated air within the structure housing the fireplace and gas log set. As will be more fully appreciated from subsequent portions of this disclosure, the generated system of primary air resulting from the operation of fan 30, is designed to effectively induce the relatively warm or hot air surrounding the gas log set G into the system of air where the same combines therewith and is exhausted out exhaust end 26 for purposes of heating.

Figure 1:
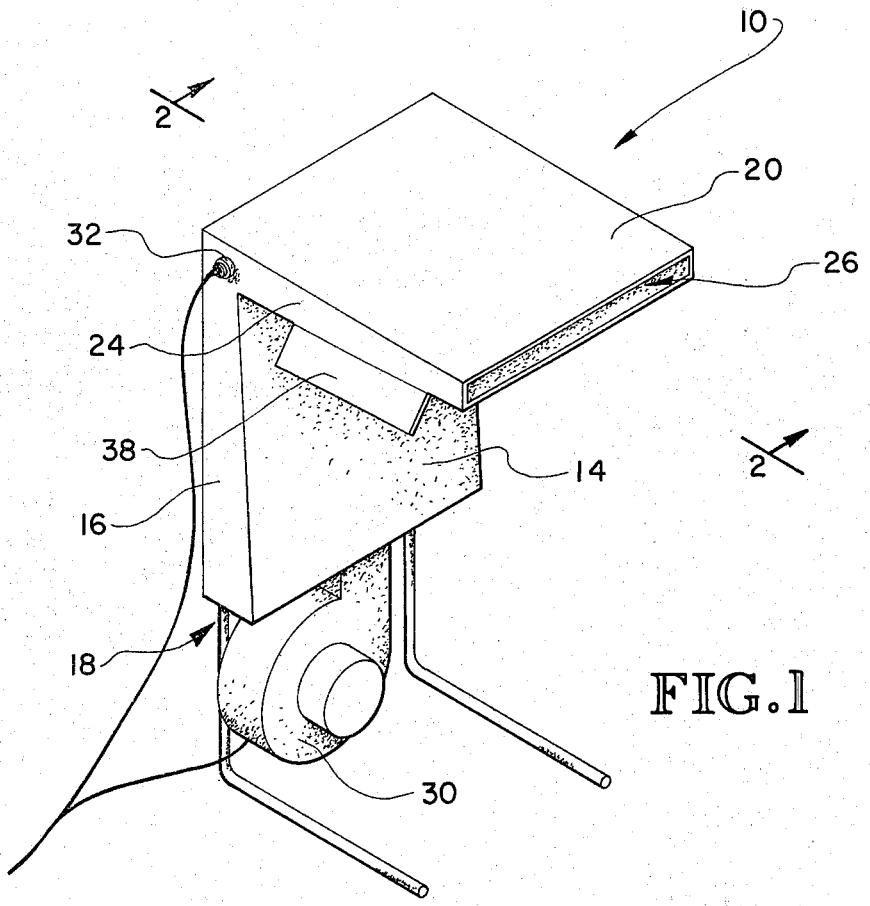
FIG. 1 is a perspective view of the apparatus or heat exchanger device of the present invention.
Figure 2:
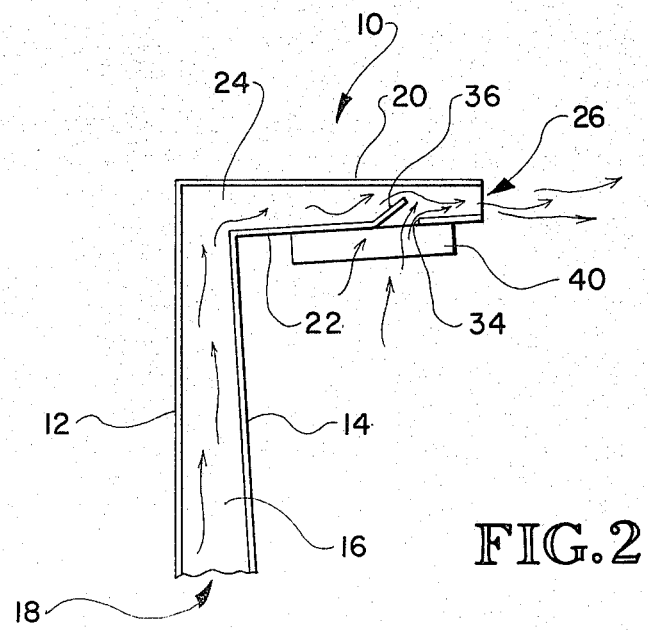
FIG. 2 is a fragmentary sectional view taken along lines 2—2 of FIG. 1.

In accomplishing this, the bottom 22 of the horizontal duct section is provided with a transverse opening 34. Extending from the rear edge of opening 34, as viewed in FIGS. 2 and 3, is a plate 36 that extends at an incline or angle over opening 34 in the direction of air flow from the primary system of air passing through the horizontal duct section. Plate 34 includes a terminal edge that terminates in spaced apart relationship with respect to the top 20 of the horizontal duct section. Plate 36 effectively forms a restriction in the horizontal duct section. As the primary system of air is moved over plate 36, a vacuum or suction effect is created about the opening 34 which results in air underneath the horizontal section being induced into the apparatus and the duct structure thereof. Because of the position of the apparatus and duct structure, the air induced into opening 34 is the relatively warm or hot air resulting from the heat produced by the gas logs G.

Once induced this relatively warm or hot air mixes with the primary system of air to form a final heated system of air which is exhausted out of the exhaust end 26 of the horizontal section.

In the case of the disclosure herein, the top horizontal duct section is provided with a pair of baffle plates 38 and 40 which tend to efficiently retain the relatively warm or heated air about the apparatus or heat exchanger device 10.

Also it is seen that the apparatus or heat exchanger device 10 includes an adjustable leg support structure 28. Adjustable leg support structure 28 is designed such that the apparatus or heat exchanger device 10 can be adjusted with respect to the fireplace P and/or the gas log set G to efficiently position the same for the most efficient operation.

It is appreciated from the foregoing specification that the present invention presents a relatively simple apparatus or heat exchanger device that is designed to efficiently capture heat resulting from a gas log set or other like heating device and to distribute the heat within an adjacent room or rooms or otherwise as selected throughout the structure. The device of the present invention utilizes an efficient and unique approach to inducing the relatively warm or heated air into the apparatus and combining the same with a primary system of air to form a final heated system of air which is efficiently discharged from the apparatus into the structure for heating the same.

The present invention, of course, may be carried out in other specific ways than those herein set forth without departing from the spirit and essential characteristics of the invention. The present embodiments are, therefore, to be considered in all respects as illustrative and not restrictive, and all changes coming within the meaning and equivalency range of the appended claims are intended to be embraced therein.

What is claimed is:

1. An apparatus for use in conjunction with a fireplace having gas logs for effectively receiving heat generated by said gas logs and disbursing the same outwardly from said fireplace in a forced air fashion, comprising:

(a) a duct structure adapted to be situated within a fireplace, said duct structure having:
  (i) an inlet end and exhaust end;
  (ii) an intermediate duct portion disposed between said inlet and exhaust ends and normally assuming a position over said gas logs when said duct structure is situated in said fireplace;
  (iii) an opening formed in and across a selected area of said intermediate duct portion over the area normally occupied by said gas logs; and
  (iv) an inclined plate extending generally over said opening at an incline in the general direction of air passing within said duct structure; and (b) fan means operatively associated with said duct structure for generating and directing a system of air into said inlet end and causing the system of air to move through said duct structure and to rush over said plate and the opening underlying said plate whereby to draw heated air from said gas logs into said duct structure opening to combine with said system of air generated by said fan means to form a warm system of air that is exhausted out said exhaust end of said duct structure into a surrounding area about said fireplace.

2. A method for efficiently capturing heat produced by gas logs within a fireplace of a structure and distributing the captured heat in a forced air system into the structure for heating the same, comprising the steps of:

(a) generating a system of forced air with a fan:

(b) directing the system of forced air into a duct structure having a portion that extends generally over said gas logs within said fireplace;

(c) confining the system of air within said duct structure as it is moved therethrough;

(d) drawing relatively warm air heated by said gas logs and existing about the area of said gas logs into said duct structure through an opening in said duct structure through which said relatively warm air may enter;

(e) restricting the flow of said system of air generated by the fan through said duct structure in an area adjacent said opening so as to give rise to a pressure differential across the restricted area to provide a suction effect for inducing the relatively warm air heated by said gas logs into said opening and into said duct structure;

(f) combining the induced relatively warm air with said system of air passing within said duct structure to form a heated system of air; and (g) exhausting said heated system of air out said duct structure into an area of said structure being heated for heating the same.

* * * * *